US008469414B2

(12) United States Patent
Constantinou

(10) Patent No.: US 8,469,414 B2
(45) Date of Patent: Jun. 25, 2013

(54) ADJUSTABLE CYLINDRICAL LOCK SET

(75) Inventor: John Constantinou, North Ringwood (AU)

(73) Assignee: ASSA ABLOY Australia Pty Limited, Oakleigh, Victoria (AU)

( * ) Notice: Subject to any disclaimer, the term of this patent is extended or adjusted under 35 U.S.C. 154(b) by 463 days.

(21) Appl. No.: 12/629,507

(22) Filed: Dec. 2, 2009

(65) Prior Publication Data

US 2010/0139335 A1 Jun. 10, 2010

(30) Foreign Application Priority Data

Dec. 2, 2008 (AU) ..... 2008906241

(51) Int. Cl.
*E05B 1/00* (2006.01)
*E05B 3/00* (2006.01)
*E05C 1/12* (2006.01)

(52) U.S. Cl.
USPC ..... 292/347; 292/336.3; 292/348; 292/169

(58) Field of Classification Search
CPC ..... E05B 55/005; E05B 85/16
USPC ..... 292/169, 169.22, 169.23, 336.3, 292/336.5, 348, 356–359, 347, DIG. 60; 70/DIG. 75
See application file for complete search history.

(56) References Cited

U.S. PATENT DOCUMENTS 3,934,437 A 1/1976 Crepinsek
4,728,133 A * 3/1988 Valley ..... 292/336.3
4,976,480 A * 12/1990 Dixon et al. ..... 292/353
5,265,924 A * 11/1993 Kim ..... 292/336.3
6,101,856 A * 8/2000 Pelletier et al. ..... 70/472
6,131,970 A 10/2000 Hurst et al.
6,302,457 B1 10/2001 Shen
6,357,270 B1 * 3/2002 Vazquez ..... 70/472
6,425,613 B1 * 7/2002 Shen ..... 292/348
6,557,909 B2 * 5/2003 Morris ..... 292/169.15
6,575,006 B1 6/2003 Don
6,619,710 B1 * 9/2003 Hwang ..... 292/336.3
6,735,993 B2 * 5/2004 Eller et al. ..... 70/224
7,571,941 B2 * 8/2009 Chang ..... 292/347
2002/0116964 A1 * 8/2002 Koskela et al. ..... 70/224
2003/0222464 A1 * 12/2003 Don ..... 292/347
2004/0070216 A1 * 4/2004 Qing ..... 292/336.3
2007/0096479 A1 5/2007 Lin et al.

FOREIGN PATENT DOCUMENTS

DE 20314117 U1 2/2004

OTHER PUBLICATIONS

ASSA ABLOY Australia Pty Limited, Australian Application No. 2008906241. filed Dec. 2, 2008, International-Type Search Report of the Australian Patent Office, dated Jul. 9, 2009.

* cited by examiner

*Primary Examiner* — Thomas Beach
*Assistant Examiner* — Nathan Cumar
(74) *Attorney, Agent, or Firm* — Michael G. Johnston; Moore & Van Allen PLLC

(57) ABSTRACT

This invention relates to a cylindrical lock assembly and the combination of the cylindrical lock assembly and bolt assembly. The lock assembly includes a chassis housing an actuator that is rotatable about an axis xx to move a shuttle relative to the chassis. The shuttle operatively engages the bolt assembly to retract the latch bolt. The lock set also includes outer furniture which is adjustable in its position relative to the shuttle to accommodate doors of a range of thickness.

29 Claims, 6 Drawing Sheets

ADJUSTABLE CYLINDRICAL LOCK SET

This application claims priority to Australian Patent Application no. 2008906241, filed Dec. 2, 2008, entitled "ADJUSTABLE CYLINDRICAL LOCK SET", naming John Constantinou as the inventor. The contents of the above-listed application is incorporated herein by reference in its entirety, and the benefit of the filing date of the earlier filed application is hereby claimed for all purposes that are legally served by such claim for the benefit of the filing date.

This invention relates to a cylindrical lock set for use on any one of a range of door panels of different thickness, a lock assembly and furniture for use in such a lock set.

A cylindrical lock set generally includes a lock assembly for location in a cylindrical aperture formed in the door and a bolt assembly operatively connected to the lock assembly for location in a bore adjacent the aperture. The lock assembly interacts with the bolt assembly at the periphery of the cylindrical aperture, which distinguishes a cylindrical lock set from other forms of locks. It is generally desirable that the bore is centrally located within the thickness of the door panel, so as to provide even cover on both sides of the bolt assembly for resisting circumvention. The lock set also includes furniture operatively connected to the lock assembly. Components of the furniture are associated with either, or both of, the inner and outer side of the door. The lock assembly is generally fixed in a position relative to the furniture component on the outer side of the door by using fastening means such as bolts.

The thickness of a door panel may be selected from a range of thicknesses, generally having regard to the frame in which it is to be used, or function it is to perform. The frame may be a relatively thin aluminum frame in which case the door panel may be similarly thin to complement the frame. The door may be functioning as a high security door, in which case the door may need to be relatively thick. Door panels for use with cylindrical lock sets in a domestic or commercial dwelling are generally selected from the range of 32 mm to 50 mm. It is therefore desirable to provide a cylindrical lock set capable of suiting the thickness of the door. While one option is to provide a range of lock sets for the differing door thicknesses, it is not practical for locksmiths to stock such a range.

A cylindrical lock set will generally include a lock assembly having a chassis, an actuator and a shuttle that is moved relative to the chassis in response to operation of the actuator. The shuttle is connected to the bolt assembly so that operation of the actuator causes retraction of a bolt of the assembly. An option for providing the thickness adjustment is to include a shuttle having a width of a relatively thin door, and allow for the attachment of the bolt assembly at any location along the width of the shuttle. It will be appreciated that with the chassis fixed in position relative to the outer side of the door, the bolt assembly will be attached in a relatively central location on the shuttle if the door is relatively thin. However in the case of a relatively wide door the attachment will be at a distal end of the shuttle. Where the bolt assembly is attached to the shuttle at its extremity, this can result in a misalignment of the forces required to retract the bolt.

The furniture for use in a cylindrical lock set includes a hand engageable member that is used to operate the actuator. The hand engageable member generally includes either a lever or knob that is rotated about an axis perpendicular to the plane of the door to operate the actuator. The lock assembly generally includes locking means for rendering the actuator inoperable. The locking means may be operated from the inner side of the door by a button which is often located at the axis and positioned on the face of the lever or knob. However if the position of the furniture relative to the lock assembly is adjusted to accommodate a thick door, the button may be recessed within the knob or lever so as to render it unserviceable. Conversely the button may stick out too far when used in a thin door making it unsightly.

The actuator of the lock assembly is normally biased towards a rest position by a biasing means forming part of the lock assembly. When a knob is used to operate the actuator the forces acting around the axis are balanced, whereas for a lever the forces are eccentric and act against the biasing means. This makes it difficult selecting a single biasing means that is suitable for use with either a lever or a knob. A biasing means suitable for retaining a lever level when at rest may be too difficult to overcome when used with a knob.

It is desirable to provide a cylindrical lock set that addresses some of these problems, and in particular one that is relatively easily adjusted by the installer.

According to a first aspect of this invention there is provided a cylindrical lock set for use on any one of a range of door panels of different thickness, the lock set including a lock assembly having a chassis which in use is located in a cylindrical aperture extending from an inner side to an outer side of the door, the chassis housing an actuator that is rotatable about an actuation axis and housing a shuttle that is moved linearly relative to the chassis in response to operation of the actuator, the shuttle is operatively attached to a bolt assembly that is located in a bore extending from an edge of the door to the cylindrical aperture, the lock set also including furniture including an outer rose for positioning adjacent the outer side of the door, the lock set also including spacing means associated with the furniture and the chassis to permit adjustment of the position of the shuttle in the axial direction relative to the outer rose.

It is preferred that the spacing means is associated with the outer rose so as to permit adjustment of the position of the chassis relative to the outer rose. It is further preferred that the spacing means permits the outer rose to be detachably connectable to the chassis. It is further preferred that the spacing means is configured to permit unitary incremental adjustment of the shuttle in the axial direction. The spacing means preferably includes a detent which in an inactive condition permits adjustment of the position of the shuttle in the axial direction, and in an active condition fixes the position of the shuttle. It is preferred that the detent is associated with the chassis so as to move therewith and includes biasing means to bias the detent to adopt the active condition. It is further preferred that the spacing means includes a stud associated with the outer rose which extends in the axial direction. It is further preferred that the stud interacts with the detent when the detent is in the active condition to fix the position of the stud relative to the detent. It is further preferred that the stud is configured with a plurality of incremental features that interact with the detent to allow for unitary incremental adjustment of the stud relative to the detent. It is still further preferred that the stud includes a threaded bore to interact with a threaded fastener associated with an inner rose so as to fix the position of the inner rose relative to the chassis.

It is preferred that the lock assembly includes a lock means that when in a locked condition renders the actuator inoperable, the lock means is operable from the inner side of the door by a button which is moved in the axial direction from a rest position to depressed position to adjust the condition of the lock from the locked condition, wherein the axial position of the button relative to the chassis when the button is in a rest position is adjustable. It is further preferred that the lock assembly includes a shaft with the button at a free end of the shaft, the shaft being movable along with the button between the rest and depressed positions to adjust the condition of the lock, the button being rotatable about the axis relative to the shaft to adjust the axial position of the button relative to the chassis when the button is in the rest position. It is further preferred that the cylindrical lock set include stop means which in an active position engages the button to restrain it from rotating about the axis, the stop means being moveable in the axial direction from the active position so as to allow the button to be rotated. It is further preferred that the stop means interacts with the shaft so as to restrain the stop means from rotating relative to the shaft. It is further preferred that the stop means includes biasing means for biasing it toward the active position. It is further preferred that the button and stop means include castellated mating surfaces that interlock when the stop means is in the active position so that rotation of the button causes rotation of the shaft.

According to another aspect of this invention there is provided a cylindrical lock assembly having a chassis which in use is located in a cylindrical aperture extending from an inner side to an outer side of the door, the chassis housing an actuator that is rotatable about an actuation axis and housing a shuttle that is moved linearly relative to the chassis in response to operation of the actuator, a lock means that when in a locked condition renders the actuator inoperable, the lock means is operable from the inner side of the door by a button which is moved in the axial direction from a rest position to depressed position to adjust the condition of the lock from the locked condition, wherein the axial position of the button relative to the chassis is adjustable when the button is in a rest position.

It is preferred that the lock assembly includes a shaft with the button at a free end of the shaft, the shaft being movable along with the button between the rest and depressed positions to adjust the condition of the lock, the button being rotatable about the axis relative to the shaft to adjust the axial position of the button relative to the chassis when the button is in the rest position. It is further preferred that the cylindrical lock assembly include stop means which in an active position engages the button to restrain it from rotating about the axis, the stop means being moveable in the axial direction from the active position so as to allow the button to be rotated. It is still further preferred that the stop means interacts with the shaft so as to restrain the stop means from rotating relative to the shaft. It is still further preferred that the stop means includes biasing means for biasing it toward the active position. It is still further preferred that the button and stop means include castellated mating surfaces that interlock when the stop means is in the active position so that rotation of the button causes rotation of the shaft.

According to still another aspect of this invention there is provided furniture for use with a cylindrical lock assembly having a chassis housing an actuator that is operable to retract a shuttle relative to the chassis from a rest position and actuator biasing means for urging the actuator toward the rest position, the furniture including a rose for location adjacent a door, drive means which is rotatable from a rest position by a hand engageable member relative to the rose for operating the actuator, and selectively operable drive biasing means that in an operative condition urges the drive means to adopt the rest position.

It is preferred that the drive biasing means when operative urges the drive means once it is rotated from the rest position. It is further preferred that the drive means is rotatable relative to the rose in both a clockwise or anticlockwise direction to operate the actuator, and the drive biasing means when operable urges the drive means once rotated in either direction. It is still further preferred that the furniture include a selector for selecting the condition of the drive biasing means. It is still further preferred that the selector is an abutment that is connected to the rose when the drive biasing means is in an operative condition against which the drive biasing means abuts. It is still further preferred that the abutment is detachable from the rose when the drive biasing means is in an inoperative condition. It is still further preferred that the hand engageable means is a rotatable lever or a knob. It is still further preferred that the operative condition is selected for the drive biasing means when the hand engageable means is a lever, and the inoperative condition is selected for the drive biasing means when the hand engageable means is a knob. It is still further preferred that the drive biasing means includes a plurality of torque settings when in the operative condition. It is still further preferred that the drive biasing means includes a torsion spring.

It will be convenient to hereinafter describe preferred embodiments of the invention in detail with reference to the accompanying drawings. It ought to be appreciated however that the detailed description in the accompanying drawings are merely illustrative of how the invention might be put into effect. The specific form and arrangement of the various features shown and described is not to be understood as limiting on the invention.

Figure 1:
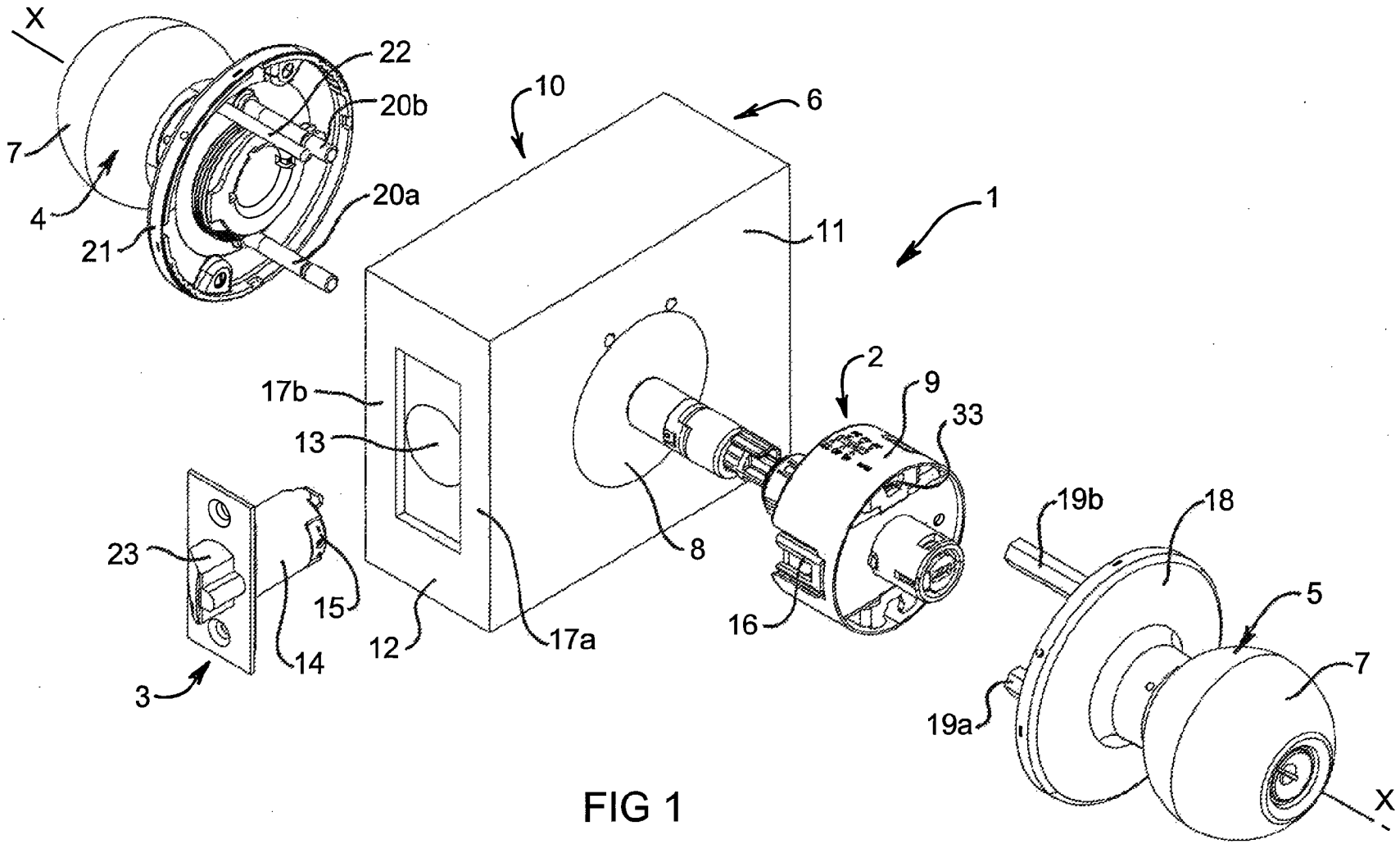
FIG. 1 is an isometric exploded view of a preferred embodiment of the lock set according to one aspect of this invention.

Referring to FIG. 1 which illustrates in summary a cylindrical lock set 1 including a lock assembly 2, a bolt assembly 3, inner furniture 4 and outer furniture 5 located in use on opposing sides of a door 6. It ought to be appreciated that only a portion of the door 6 is illustrated to simplify the illustration.

Figure 11:
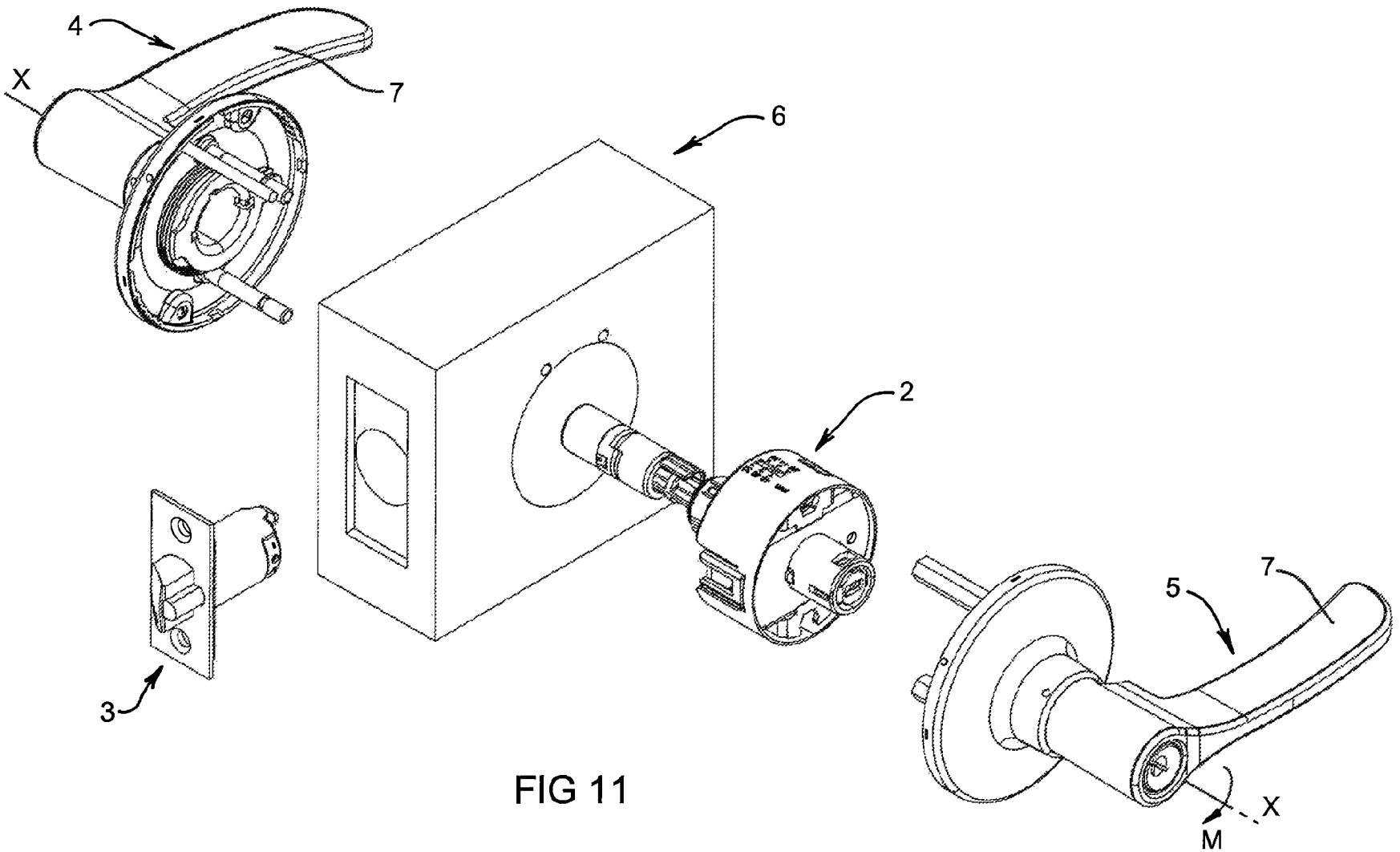
FIG. 11 is an isometric exploded view of a further preferred embodiment of the lock set according to another aspect of this invention.

The inner 4 and outer furniture 5 illustrated include a preferred form of hand engagable member 7 in the form of a doorknob. This is one form of hand engagable member 7 that may form part of the lock set 1, however other forms are possible. An alternate form of hand engagable member 7 in the form of a lever is illustrated in FIG. 11 and will be discussed later in the specification.

A cylindrical aperture 8 is formed in the door 6 so as to accommodate a chassis 9 of the lock assembly 2. The aperture 8 extends from an inner surface 10 (obscured) of the door 6 to an outer surface 11 of the door 6. A bore 13 is formed from a side edge 12 of the door 6, and extends to the cylindrical aperture 8. The bore 13 accommodates a housing 14 of the bolt assembly 3 so as to allow the bolt assembly 3 to interact with the lock assembly 2. More specifically, a tail bar 15 of the bolt assembly 3 is brought into engagement with a shuttle 16 of the lock assembly 2, whereby this engagement occurs at the periphery of the cylindrical aperture 8. An actuator (obscured) housed within this chassis 9 operates in response to rotation of the hand engagable member 7 about an actuation axis xx. The actuator operates to cause movement of the shuttle in a direction perpendicular to the axis xx. This movement of the shuttle 16 causes retraction of a latch bolt 23 relative to the housing 14.

It ought to be noted from FIG. 1 that the centre of the bore 13 is aligned with the centre of the thickness of the door panel 6. This provides an even amount of cover 17*a*, 17*b* on either side of the bolt assembly housing 14.

The outer furniture 7 includes a rose 18 with a pair of studs 19*a*/19*b* extending from a rear surface thereof. The studs 19*a*/19*b* extend through and engage with the chassis 9 to function as a spacing means in a manner that will be understood with reference to later illustrations. The studs 19*a*/19*b* are engaged by fastening elements, preferably bolts 20*a*, 20*b*, associated with a rose 21 of the inner furniture 4. A further fastening means, in the form of a screw 22, is included to engage the door panel 6 to resist rotation of the inner rose 21 relative to the door panel 6.

Figure 2:
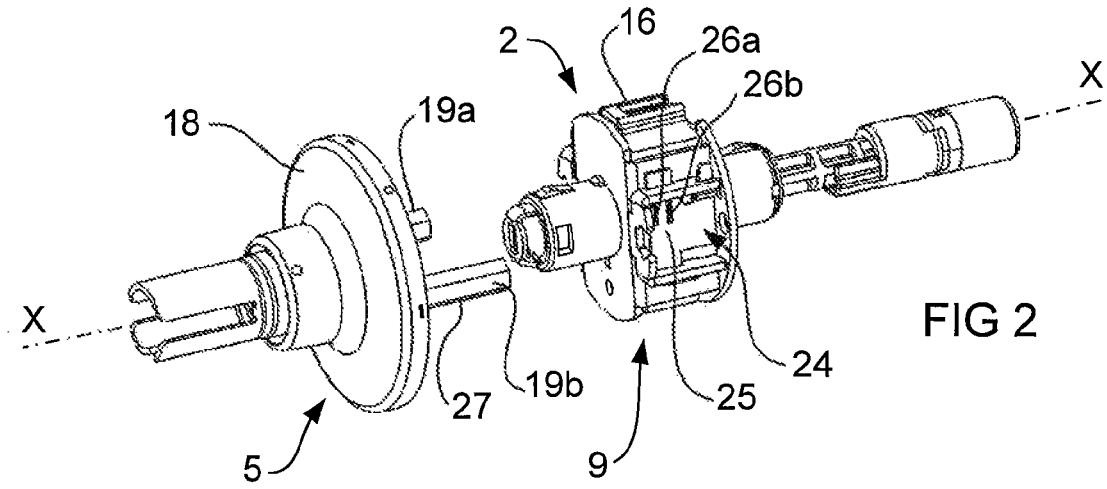
FIG. 2 is an isometric exploded view of the lock assembly and outer furniture with the knob removed from FIG. 1.

FIG. 2 illustrates the lock assembly 2 and a portion of the outer furniture 5 which is normally located on the outer side of the door 6. The inner furniture 4 normally located on the inner side of the door 6, along with the chassis housing, has been removed to facilitate an ease of understanding as to how adjustment of the spacing means causes adjustment of the position of the shuttle 16 in the axial direction relative to the outer rose.

The spacing means permits adjustment of the position of the shuttle relative to the outer rose. Any form of spacing means may be suitable, and the form of spacing means illustrated is only one preferred form. The preferred form illustrated includes the stud 19*b* extending from the outer rose 18 which interacts with a detent 24 located on a side of the chassis 9. The detent 24 includes a movable plate member 25 which is moved perpendicular to the actuation axis xx so as to space teeth 26*a*/26*b* associated with the plate member 25, from grooves 27 associated with the stud 19*b*.

Figure 3:
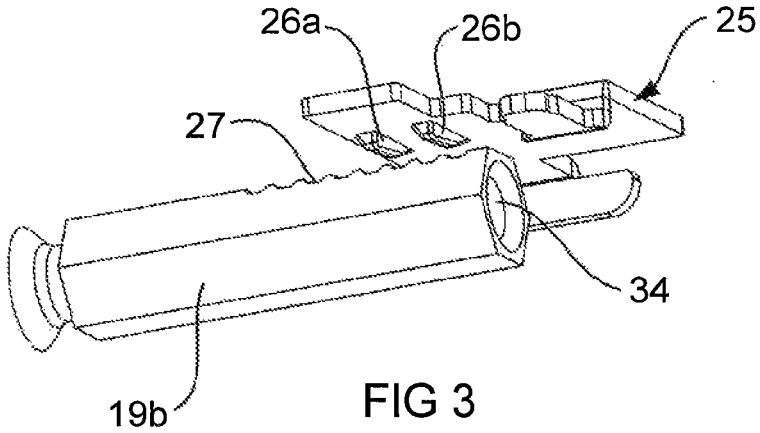
FIG. 3 is an isometric view of a preferred form of spacing means according to a preferred aspect of this invention.

The teeth 26*a*/26*b* and grooves 27 are more clearly illustrated in FIG. 3. It can be seen that the stud 19*b* includes a plurality of grooves 27 that interact with the teeth 26*a*/26*b* which allows for unitary incremental adjustment of the stud 19*b* relative to the detent 24. The number and spacing of the grooves 27 may be selected to align with the thickness of the door 6, whereby each spacing of groove 27 equates to 1 mm of thickness of the door 6. It is to be appreciated that the location of the teeth 26*a*/26*b* and grooves 27 may be swapped, so that the teeth 26 are located on the stud 19*b* to engage in grooves 27 formed in the plate 25.

The detent 24 is considered to be in an inactive condition when the teeth 26 are spaced from the grooves 27, as in this position the stud 19*b* can be moved in the axial direction xx relative to the detent 24. When the desired spacing is reached, the plate member 25 is moved so that the teeth 26 engage in the grooves 27 associated with the stud 19*b*. The detent 24 is considered to be in an active condition when the teeth 26 are located within the grooves 27, as the stud cannot be moved in an axial direction xx.

Figure 4:
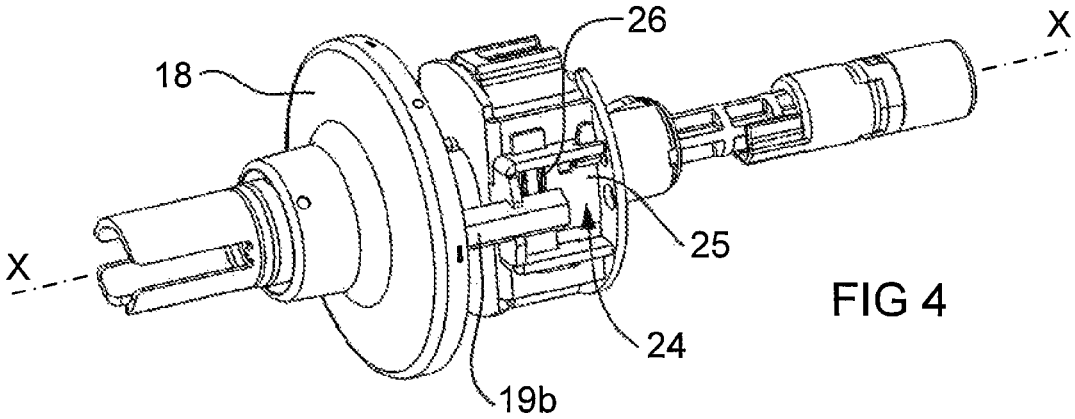
FIG. 4 is an isometric view of the lock assembly and furniture from FIG. 2 in an assembled condition.
Figure 5:
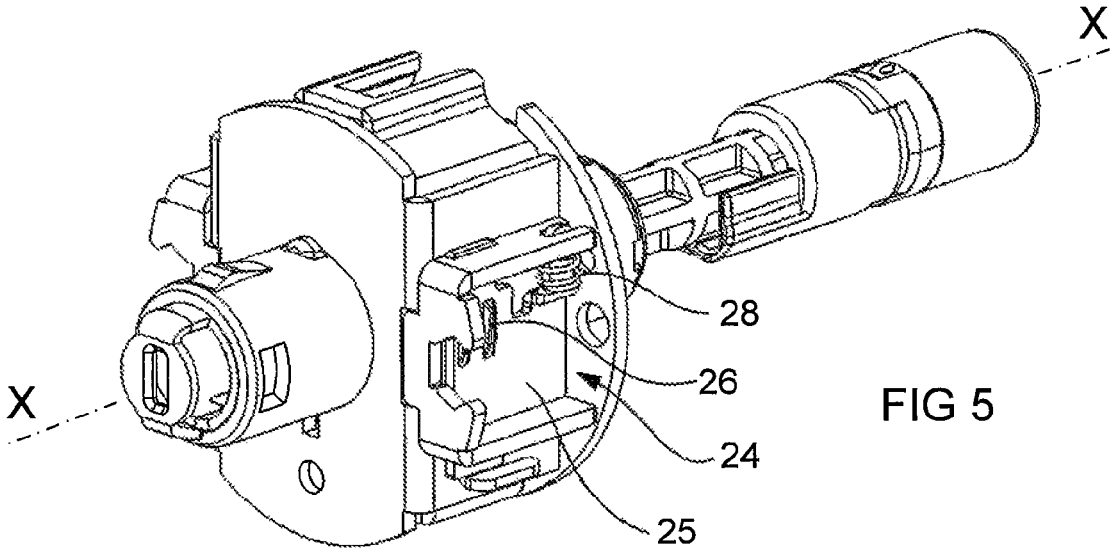
FIG. 5 is an isometric view of the lock assembly from FIG. 2.

FIG. 4 illustrates the stud 19*b* adjacent the teeth 26 with the detent in the inactive position. In contrast, FIG. 5 illustrates the detent 24 in the active position whereby the plate member 25 is moved perpendicular to the axis xx under influence of the compression spring 28. The invention is not limited to movement of the plate member in the direction illustrated, and a similar function could be achieved by a plate movement in the radial direction. Furthermore, the compressional spring 28 illustrated is only one form of biasing means that is suitable for achieving the desired function, and other forms of biasing means are clearly possible.

Figure 6:
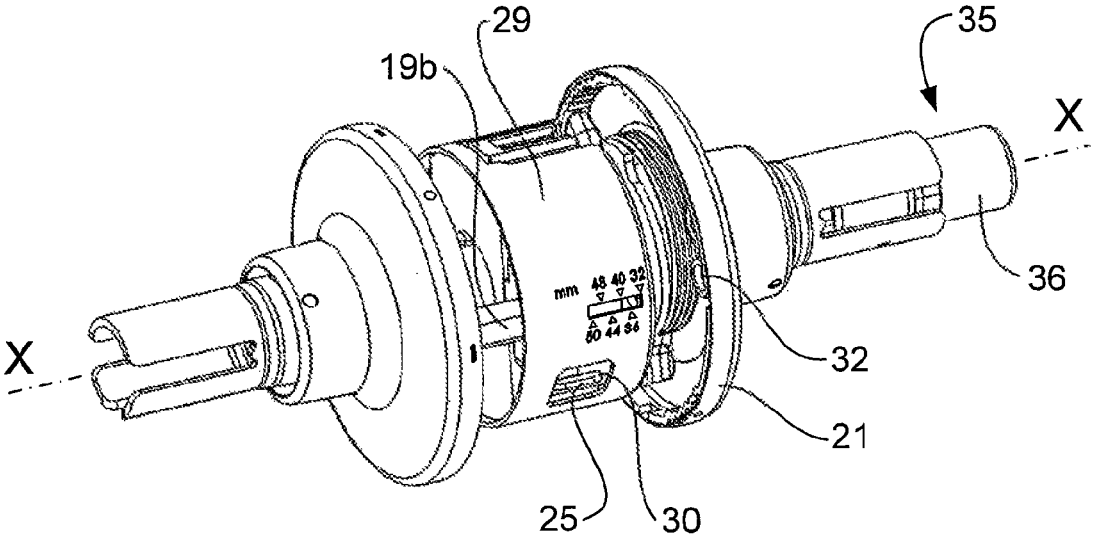
FIG. 6 is an isometric view of the lock assembly and outer furniture from FIG. 4 in combination with inner furniture.

Referring now to FIG. 6 which illustrates the chassis housing 29 located over the chassis body (obscured). In particular, the preferred chassis housing 29 illustrated includes an aperture 30 through which the detent can be adjusted between the active and inactive conditions by moving the plate 25. Furthermore, the chassis housing 29 includes a viewing window 31 through which the position of the stud 19*b* relative to the detent can be viewed. Measurements are provided on the chassis housing 29 adjacent the viewing window 31 which correspond to the incremental adjustments permitted between the stud 19*b* and detent. In the embodiment illustrated the measurements show an adjustment between 32 mm and 50 mm, however, the invention is not limited to adjustments within this range.

FIG. 6 also illustrates the inner rose 21 including an aperture 32 which is aligned with an aperture 33 (see FIG. 1) in the chassis body and a bore 34 (see FIG. 3) formed in the stud 19*b*. The apertures 32, 33 and bore 34 are provided to receive the fastening element 20*b* (see FIG. 1) in the form of a bolt or the like for attaching the inner rose 21 to the stud 19*b*. Tightening of the bolt 20*b* onto the stud 19*b* will clamp the inner rose 21 onto the inner surface 10 of the door 6.

It ought to be appreciated that the axial position xx of the inner rose 21 relative to an inner shaft 35 will vary according to the thickness of the door 6. This adjusts the position of the inner furniture 4 relative to a button 36 located at a distal end of the shaft 35. The shaft 35 is used to operate a locking means (obscured) of the lock assembly and when control of the locking means by a key is not required of the lock set. The shaft 35 may need to be moved in the axial direction xx, or rotated about the axis xx to operate a function or functions of the locking means. The position of the button 36 relative to the knob 7 (See FIG. 1) needs to be such as to allow engagement by the user whilst not extending excessively from the knob 7.

Figure 7:
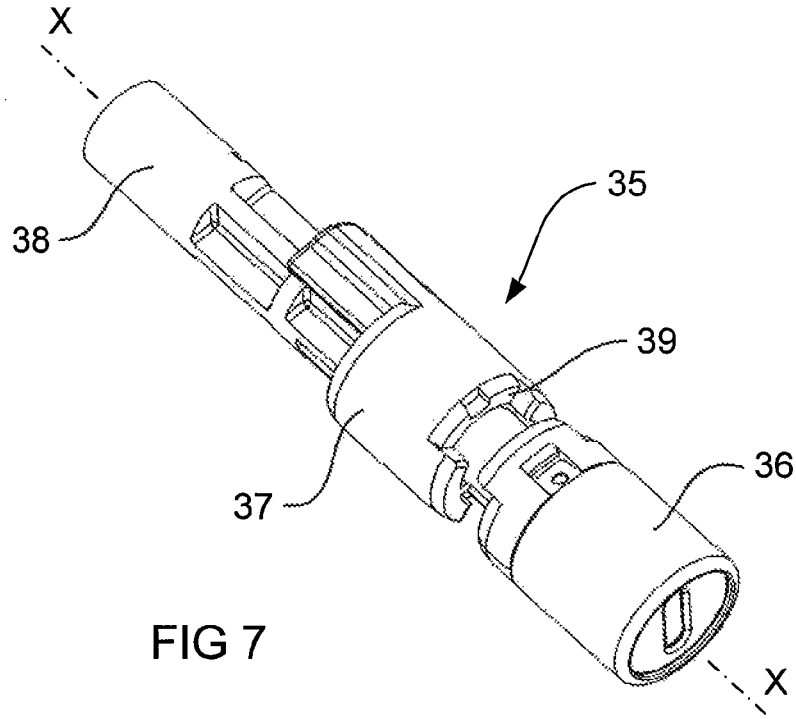
FIG. 7 is an isometric view of a shaft for operating lock means of the lock assembly.

FIG. 7 illustrates the shaft 35 in isolation from the chassis 9, and illustrates in particular a stop means 37 moved in the axial direction xx to disengage from the button 36. The stop means 37 interacts with a rod 38 so as to resist rotation about the axis xx relative to the rod 38. The stop means 37 includes a mating surface 39 that interlocks with the button 36. The preferred form of mating surface 39 illustrated is a castellated mating surface on both the stop means 37 and the button 36, however other forms of mating surface may also be suitable.

Figure 8:
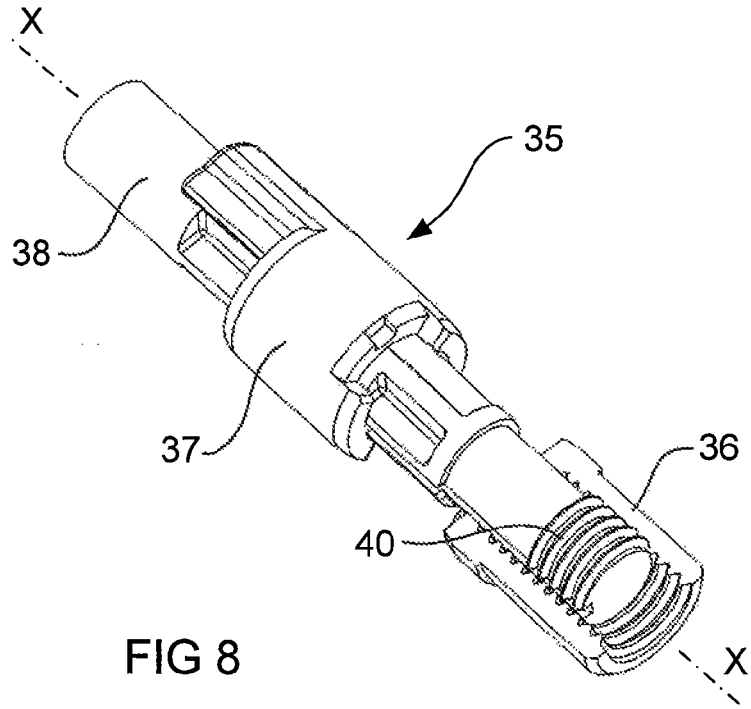
FIG. 8 is an isometric view with a portion of the button from FIG. 7 removed to reveal a threaded shaft.

When the stop means 37 is moved from the active position, as is illustrated in FIG. 7, the button 36 can be rotated relative to the rod 38. Referring now to FIG. 8 which illustrates half of the button 36 removed to expose a threaded connection between the button 36 and the rod 38. The threaded connection allows for rotation of the button 36 relative to the rod 38 thereby moving the button 36 in the axial direction xx. The pitch of the thread 40 on the rod 38 may be selected so that a complete rotation of the button 36 results in a millimetre of adjustment. This may correspond to the variations in thickness of the door 6. Clearly threads with other pitch to achieve a different rotation to thickness ratio are possible.

The cylindrical lock set 1 may be operated by a hand engageable member 7 in the form of a handle (see FIG. 11) or a turn knob (see FIG. 1). Where a turn knob 7 is used (see FIG. 1), it would be appreciated that the weight of the turn knob 7 is evenly balanced around the actuation axis xx. In contrast when a handle 7 is used (see FIG. 11) the weight will be unbalanced to one side of the actuation axis xx, causing a moment M about the actuation axis xx. One option for balancing this moment M is to increase the strength of the biasing means (obscured) acting on the actuator (obscured) of the lock assembly 2. However, if the lock assembly 2 is to be suitable for use with a turn knob or handle, increasing the strength of the biasing means may render the turn knob 7 unrotatable for some users. This is particularly the case for users that have insufficient strength in their hands such as the young or sufferers of arthritis.

Figure 9:
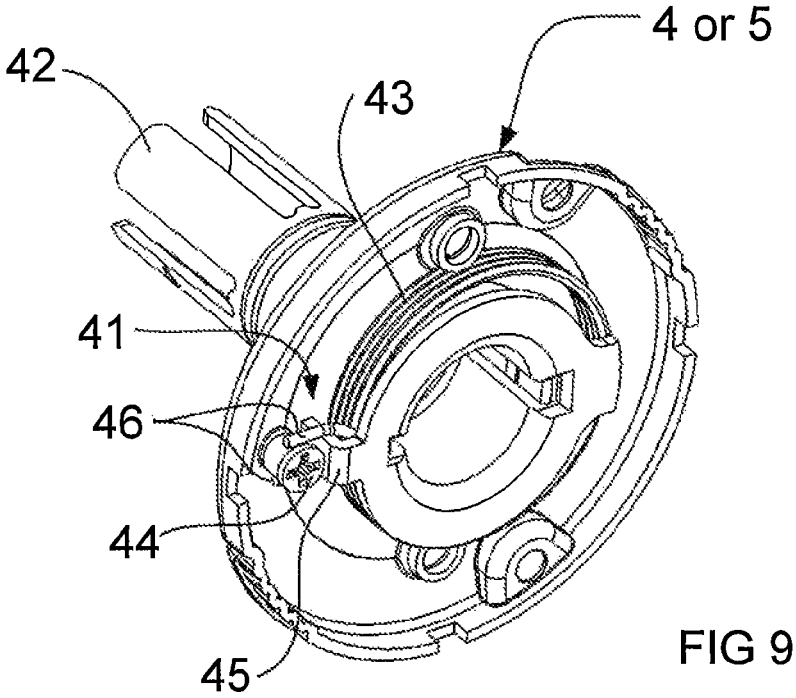
FIG. 9 is an isometric view of the inner furniture with the biasing means in an operative position.

In order to address this issue FIG. 9 illustrates the furniture 4 or 5 including a selectively operable drive biasing means 41 that in an operative condition urges a drive means 42, and in turn the handle 7, to adopt a rest position (see FIG. 11). The form of drive biasing means illustrated includes a torsion spring 43, and this form is preferred. The torsion spring 43 abuts against a short bolt 44 which is detachably attached to the rose 4 or 5. The drive means 42 includes an arm 45 which also abuts against a free end 46 of the torsion spring 43 so that rotation of the handle 7 and therefore the drive means 42 causes the torsion spring 43 to store potential energy, thereby assisting the actuator returning the shuttle to a rest position.

FIG. 9 illustrates the drive means 42 capable of being rotated in either a clockwise or anti-clockwise direction whilst still engaging a free end 46 of the torsion spring 43. This allows the cylindrical lock set 1 to be installed in a left handed or right handed configuration.

Figure 10:
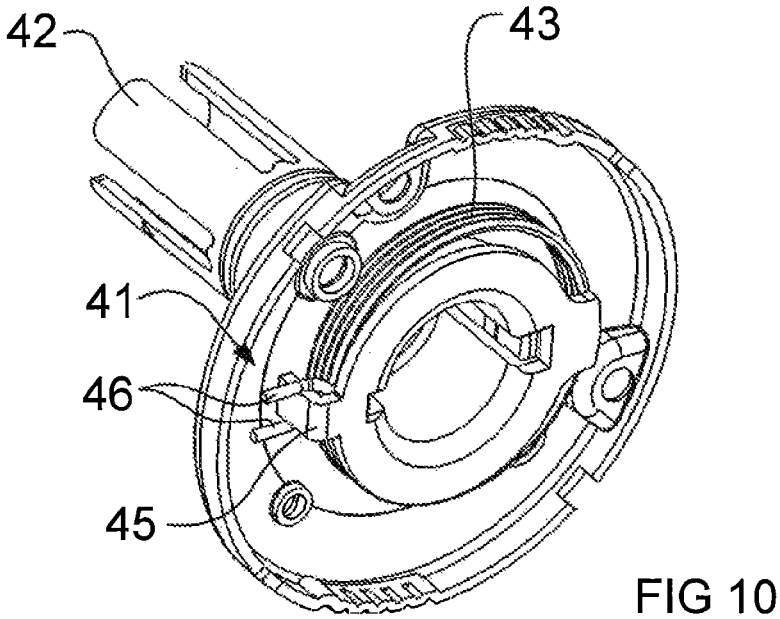
FIG. 10 is an isometric view of the furniture from FIG. 9 with the biasing means in the inoperative condition.

The short bolt 44 is detachable from the rose (see FIG. 10) so as to render the drive biasing means 41 inoperable. It is intended that the drive biasing means 41 be rendered inoperable when used with a turn knob 7 (see FIG. 1). A further bolt 44 may be added to space the free ends 46 of the torsion spring to increase the torque stored in the spring. Still furthermore the rose may include a plurality of formations to receive the bolt 44 so as to provide further adjustment of the torque.

It should be appreciated from the foregoing description that the present invention provides a lock set that requires a relatively simple adjustment to allow for door panels of a range of thicknesses. The ability to retain the position of the chassis relative to the outer rose is a particular advantage. Furthermore, the ability to adjust the length of the shaft that operates the locking means from the inner side is a further advantage. Still furthermore, the ease with which either a turn knob or handle may be selected and integrated into the lock set is a further advantage.

Various alterations, modifications and/or additions may be introduced into the constructions and arrangement of parts previously described without departing from the spirit or ambit of the invention.

I claim:

1. A cylindrical lock set for use with a range of door panels of different thickness, the door panels having a cylindrical aperture extending from an inner surface of the door panel to an outer surface of the door panel and a bore extending from an edge of the door panel and opening into the cylindrical aperture, the lock set comprising:

a lock assembly including a chassis adapted to be disposed in the cylindrical aperture of the door panel, an actuator at least partially housed in the chassis, the actuator rotatable about an actuation axis, a shuttle at least partially housed in the chassis, the shuttle operatively connected to the actuator such that the shuttle is moved linearly relative to the chassis in response to operation of the actuator, and a bolt assembly adapted to be disposed in the bore of the door panel, the bolt assembly operatively attached to the shuttle;

furniture including an outer rose for positioning adjacent the outer surface of the door panel; and spacing means associated with the furniture and the chassis, the spacing means including a detent associated with the chassis so as to move with the chassis, biasing means for biasing the detent to adopt an active condition, and a stud associated with the outer rose, the stud extending in a direction substantially parallel to the actuation axis toward the chassis and adjacent to the detent, wherein in the active condition of the detent the detent engages the stud to fix the position of the stud and the outer rose relative to the chassis, and wherein in an inactive condition of the detent permits adjustment of the position of the chassis along the actuation axis relative to the outer rose.

2. A cylindrical lock set according to claim 1 wherein the spacing means permits the outer rose to be detachably connectable to the chassis.

3. A cylindrical lock set according to claim 1 wherein the spacing means is configured to permit unitary incremental adjustment of the shuttle along the actuation axis.

4. A cylindrical lock set according to claim 1 wherein the stud is configured with a plurality of incremental features that interact with the detent to allow for unitary incremental adjustment of the stud relative to the detent.

5. A cylindrical lock set according to claim 1 wherein the stud includes a threaded bore to interact with a threaded fastener associated with an inner rose so as to fix the position of the inner rose relative to the chassis.

6. A cylindrical lock set according to claim 1 wherein the lock assembly includes a lock means that when in a locked condition renders the actuator inoperable, and further comprising a button associated with the inner side of the lock assembly for operating the lock means, the button moveable along the actuation axis from a rest position to a depressed position to adjust the condition of the lock from the locked condition, wherein the position of the button along the actuation axis relative to the chassis when the button is in the rest position is adjustable.

7. A cylindrical lock set according to claim 6 wherein the lock assembly includes a shaft having a longitudinal axis and the button at a free end of the shaft, the shaft being movable along with the button between the rest and depressed positions to adjust the condition of the lock, the button being rotatable about the longitudinal axis of and relative to the shaft to adjust the position of the button along the shaft and relative to the chassis when the button is in the rest position.

8. A cylindrical lock set according to claim 7 including stop means which in an active position engages the button to restrain the button from rotating about the longitudinal axis of the shaft, the stop means being longitudinally moveable along the shaft from the active position so as to allow the button to be rotated.

9. A cylindrical lock set according to claim 8 wherein the stop means interacts with the shaft so as to restrain the stop means from rotating relative to the shaft.

10. A cylindrical lock set according to claim 8 wherein the stop means includes biasing means for biasing the stop means toward the active position.

11. A cylindrical lock set according to claim 8 wherein the button and stop means include castellated mating surfaces that interlock when the stop means is in the active position so that rotation of the button causes rotation of the shaft.

12. A cylindrical lock assembly for a door having a cylindrical aperture extending from an inner side of the door to an outer side of the door, the cylindrical lock assembly comprising:

a chassis adapted to be disposed in the cylindrical aperture of the door;

an actuator at least partially housed in the chassis, the actuator rotatable about an actuation axis;

a shuttle at least partially housed in the chassis, the shuttle operatively connected to the actuator such that the shuttle is moved linearly relative to the chassis in response to operation of the actuator;

a lock means that when in a locked condition renders the actuator inoperable, the lock means including a shaft having a longitudinal axis; and a button at a free end of the shaft and externally accessible of the lock assembly for operating the lock means, the button and the shaft moveable along the actuation axis from a rest position to a depressed position to adjust the condition of the lock to the locked condition, the button being rotatable about the longitudinal axis of and relative to the shaft to adjust the rest position of the button along the longitudinal axis of the shaft relative to the chassis.

13. A cylindrical lock assembly according to claim 12 including stop means which in an active position engages the button to restrain the button from rotating about the longitudinal axis of the shaft, the stop means being longitudinally moveable along the shaft from the active position so as to allow the button to be rotated relative to the shaft.

14. A cylindrical lock assembly according to claim 13 wherein the stop means interacts with the shaft so as to restrain the stop means from rotating relative to the shaft.

15. A cylindrical lock set according to claim 14 wherein the stop means includes biasing means for biasing the stop means toward the active position.

16. A cylindrical lock set according to claim 14 wherein the button and stop means include castellated mating surfaces that interlock when the stop means is in the active position so that rotation of the button causes rotation of the shaft.

17. Furniture for use with a cylindrical lock assembly having a chassis housing an actuator that is operable to retract a shuttle relative to the chassis from a rest position and actuator biasing means for urging the actuator and the shuttle toward the rest position, the chassis configured to be disposed in a cylindrical aperture extending from an inner side of a door to an outer side of the door, the furniture comprising:

a rose adapted to be disposed adjacent a side of the door, a hand engageable member for operating the actuator, drive means associated with the rose and connected for rotation with the hand engageable member, the drive means rotatable from a rest position by the hand engageable member relative to the rose when operating the actuator, selectively operable drive biasing means that in an operative condition urges the drive means to adopt the rest position and in an inoperative condition does not urge the drive means to adopt the rest position, and an abutment detachably connected to the rose for selecting the condition of the drive biasing means, wherein the drive biasing means abuts the abutment when the abutment is connected to the rose for placing the drive biasing means in the operative condition and the abutment is detached from the rose for placing the drive biasing means in the inoperative condition.

18. Furniture according to claim 17 wherein the drive biasing means when operative urges the drive means once it is rotated from the rest position.

19. Furniture according to claim 17 wherein the drive means is rotatable relative to the rose in both a clockwise or anticlockwise direction to operate the actuator, and the drive biasing means when operable urges the drive means once rotated in either direction.

20. Furniture according to claim 17 wherein the hand engageable member is a rotatable lever or a knob.

21. Furniture according to claim 20 wherein the operative condition is selected for the drive biasing means when the hand engageable means is a lever, and the inoperative condition is selected for the drive biasing means when the hand engageable means is a knob.

22. Furniture according to claim 17 wherein the drive biasing means includes a plurality of torque settings when in the operative condition.

23. Furniture according to claim 17 wherein the drive biasing means includes a torsion spring.

24. A cylindrical lock set according to claim 1 wherein the detent comprises a plate member moveable in a direction substantially perpendicular to the actuation axis between the inactive condition and the active condition where the plate member engages the stud for fixing the position of the chassis relative to the outer rose.

25. A cylindrical lock set according to claim 24 wherein the detent further comprises at least one projection extending from the plate member in the direction of movement between the inactive condition and the active condition, and the stud has a plurality of longitudinally spaced grooves along an outer surface of the stud facing the plate member, wherein in the inactive condition the at least one projection is spaced from the grooves and in the active condition the at least one projection is received by one of the grooves.

26. A cylindrical lock set according to claim 8 wherein the stop means is configured to journal the shaft for relative sliding longitudinal movement of the stop means relative to the button along the shaft from the active position.

27. A cylindrical lock assembly according to claim 13 wherein the stop means is configured to journal the shaft for relative sliding longitudinal movement of the stop means relative to the button along the shaft from the active position.

28. Furniture according to claim 23 wherein the torsion spring includes a first end engaged by the drive means, and a second end engaged by the abutment, wherein the first end and the second end of the spring are separated for tensioning the spring when the drive means is rotated relative to the rose from the rest position by the hand engageable member.

29. Furniture according to claim 17 wherein the abutment is a bolt, and wherein the rose has a threaded opening for receiving the bolt for placing the drive biasing means in the operative condition.

* * * * *